United States Patent [19]

Matsunaga et al.

[11] Patent Number: 4,915,163

[45] Date of Patent: Apr. 10, 1990

[54] PLATE TYPE HEAT EXCHANGER

[75] Inventors: Ken Matsunaga, Kariya; Yoshiyuki Yamauchi, Chita; Masatoshi Sudo, Kariya; Masami Ohshita, Chiryu; Kiyomitsu Tsuchiya, Okazaki, all of Japan

[73] Assignee: Nippondenso Co., Ltd., Kariya, Japan

[21] Appl. No.: 230,030

[22] Filed: Aug. 9, 1988

[51] Int. Cl.[4] ..... F28D 1/03

[52] U.S. Cl. ..... 165/153; 29/890.039; 165/76; 165/152; 165/174; 228/183

[58] Field of Search ..... 165/76, 148, 152, 153, 165/172, 174, 176; 29/157.3 R, 157.3 D; 228/183; 219/85 R, 85 M

[56] References Cited

U.S. PATENT DOCUMENTS

| | | | |
|---|---|---|---|
| 3,451,114 | 6/1969 | Wesneke | 228/183 |
| 4,249,597 | 2/1981 | Carey . | |
| 4,696,342 | 9/1987 | Yamauchi et al. . | |
| 4,723,601 | 2/1988 | Ohara et al. . | |
| 4,800,954 | 1/1989 | Noguchi et al. | 165/153 |

FOREIGN PATENT DOCUMENTS

| | | |
|---|---|---|
| 50-69744 | 6/1975 | Japan . |
| 2056652 | 3/1981 | United Kingdom . |

*Primary Examiner*—Martin P. Schwadron
*Assistant Examiner*—Allen J. Flanigan
*Attorney, Agent, or Firm*—Cushman, Darby & Cushman

[57] ABSTRACT

A plate type heat exchanger has a plurality of tube units and a plurality of corrugated fins. Each of the tube units is formed by a pair of plates, namely a pair of plates are connected to each other by a brazing material at a connecting portion at an outer periphery of the plate and a center rib at a center axis of the plate. The center rib has an enlarged portion at the top end thereof in order to gather the molten brazing material toward the enlarged portion. The brazing at the center rib is started from the enlarged portion. Therefore a brazing defect is prevented from occurring at the top end of the center rib. Since the tube unit is effectively connected by brazing, the tube unit of the present invention has enough anti-pressure strength.

7 Claims, 8 Drawing Sheets

PLATE TYPE HEAT EXCHANGER

FIELD OF THE INVENTION

The present invention relates to a plate type heat exchanger which is useful for an evaporator of an automotive air conditioner.

BACKGROUND OF THE INVENTION

A plate type heat exchanger is formed by a plurality of tube units and a plurality of corrugated fins. The tube unit is also formed by a couple of plates such as shown in FIG. 1. Each plate is connected to a corresponding pair of plates at an outer peripheral portion 101, a center rib 102 and at a number of ribs 103. Namely, since the brazing material of aluminum alloy is clad on both the outer surface and the inner surface of the plate 100, the brazing material clad on the inner surface of the plate 100 is gathered at the connecting portions 101, 102 and 103 in order to connect a pair of plates 100 to each other. The brazing material clad on the outer surface of the plate 100 connects the corrugated fin to the tube unit.

Since the pressurized fluid is introduced into the tube unit, the tube unit should have enough sealing efficiency. According to the present inventor's study, several tube units did not have enough sealing efficiency. Eight heat exchangers has the leaking problem where the fluid within the tube unit leaked. It has been observed by the present inventors that the tube units which had a leaking problem did not connect with each other at the center rib 102. To solve this problem the present inventors have examined the relationship between the anti-pressure strength of the tube unit and the brazing area of the center rib 102.

FIG. 2 shows the test piece of the tube unit 10. The tube unit 10 shown in FIG. 2 has unbrazed area 201 where no brazing material is supplied. FIG. 3 shows the test result used by the tube unit shown in FIG. 2 by changing the non brazing area 201. The abscissa of FIG. 3 represents the length of the unbrazed area 201, and the ordinate of FIG. 3 represents the anti-pressure strength of the tube unit 10. As shown from FIG. 3, the tube unit having much unbrazed area 201 does not have enough anti-pressure strength.

Therefore, the brazing at the center rib 102, especially at the top end 105 if the center rib 102 is strongly required in order to have enough sealing efficiency of the tube unit 10. The present inventors have studied why the unbrazed area occurred at the top end 105 of the center rib 102. According to the present inventors' study, the brazing at the center rib 102 is deemed to start from the bottom end 106 of the center rib 102 and the molten brazing material flows toward the top end 105. The amount of the brazing material at the bottom end 106 is deemed to be more than the amount of the brazing material at the top end 105. Since the bottom end 106 of the center rib 102 is integrally connected to the tank portion 110, the brazing material clad on the tank portion 101 may flow toward the bottom end 106.

SUMMARY OF THE INVENTION

The object of the present invention is to provide a plate type heat exchanger having enough sealing efficiency. Another object of the present invention is to provide the tube unit having no unbrazed area at the top end of the center rib. A further object of the present invention is to provide the tube unit with a center rib which is connected by brazing in such a manner that the brazing material is molten at the top end first and then the molten brazing material flows toward the bottom end of the center rib. A further object of the present invention is to provide a plate type heat exchanger having enough anti-pressure strength.

In order to attain the above objects, the plate type heat exchanger of the present invention employs a tube unit, and the top end of the center rib is enlarged. The tube unit of the present invention is formed by a couple of plates connected to each other at the outer periphery thereof and to the center rib.

Since the top end of the center rib of the present invention is enlarged, the brazing material around the top end of the center rib is larger than the remaining part of the center rib, so that it is expected that the brazing material is molten at the top end first and then flows toward the bottom end of the center rib.

According to the present inventor's study, no heat exchanger of 73% heat exchangers leaked when the heat exchanger employed the plate having the enlarged portion at the top end of the center rib.

The plate type heat exchanger of the present invention can promote the anti-pressure strength because no unbrazed area is generated at the top end of the center rib. Furthermore, since the tube unit of the present invention is connected to each other at the center rib perfectly, the passage of the fluid passing through the tube unit is not short circuited. Therefore, the plate type heat exchanger of the present invention should have effective heat exchanging efficiency.

DETAILED DESCRIPTION OF THE PREFERRED EMBODIMENT

Figure 1:
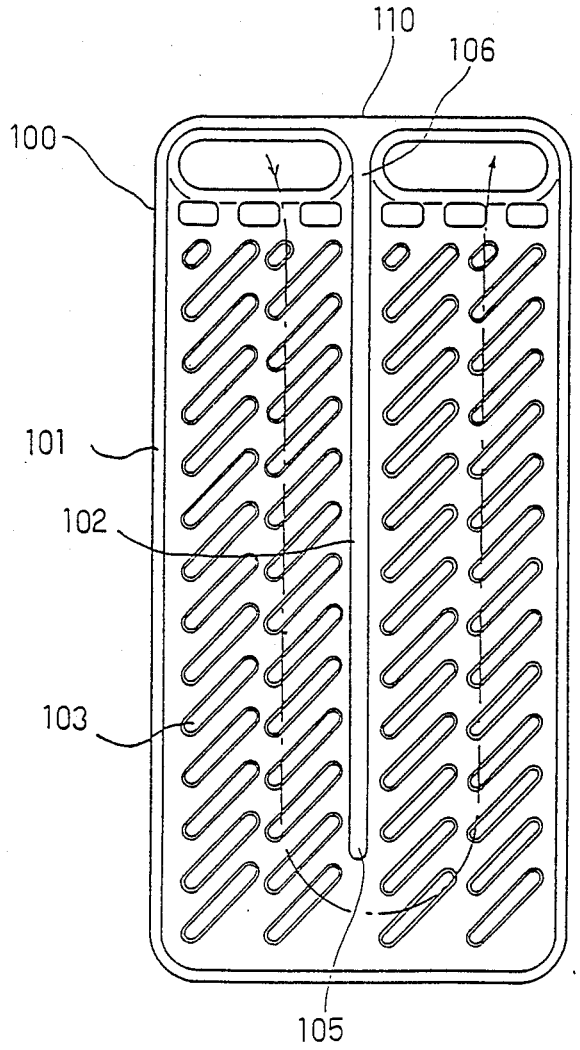
PRIOR ART FIG. 1
FIG. 1 is a front view of a plate of a conventional type of heat exchanger.
Figure 2:
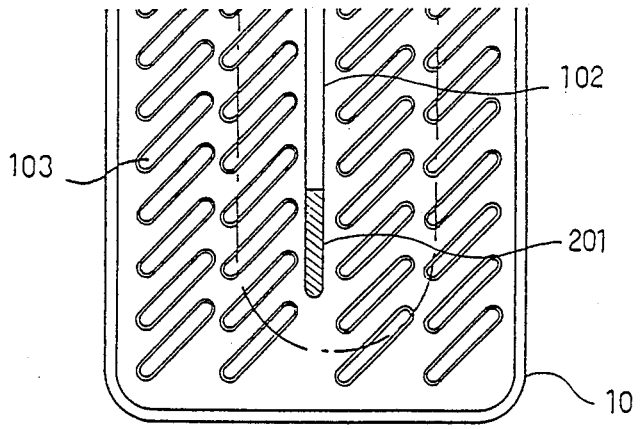
FIG. 2 is a front view of the test piece of the plate which has unbrazed area at the top end of the center rib.
Figure 3:
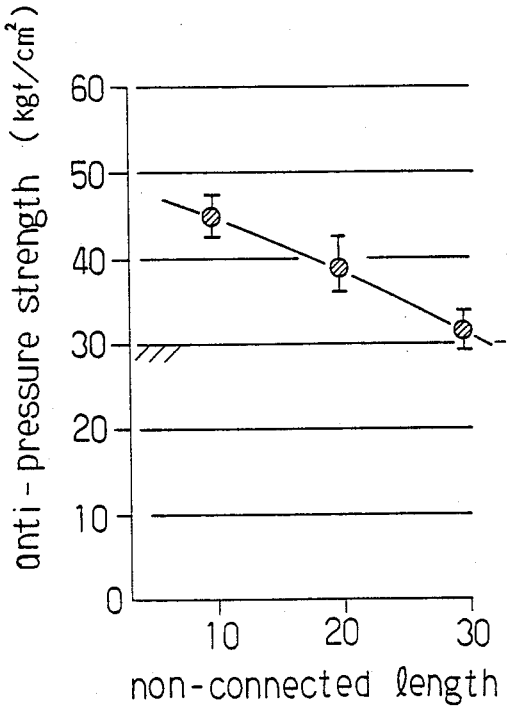
FIG. 3 shows the relationship between the length of the unbrazed area and the anti and pressure strength of the tube unit.
Figure 4:
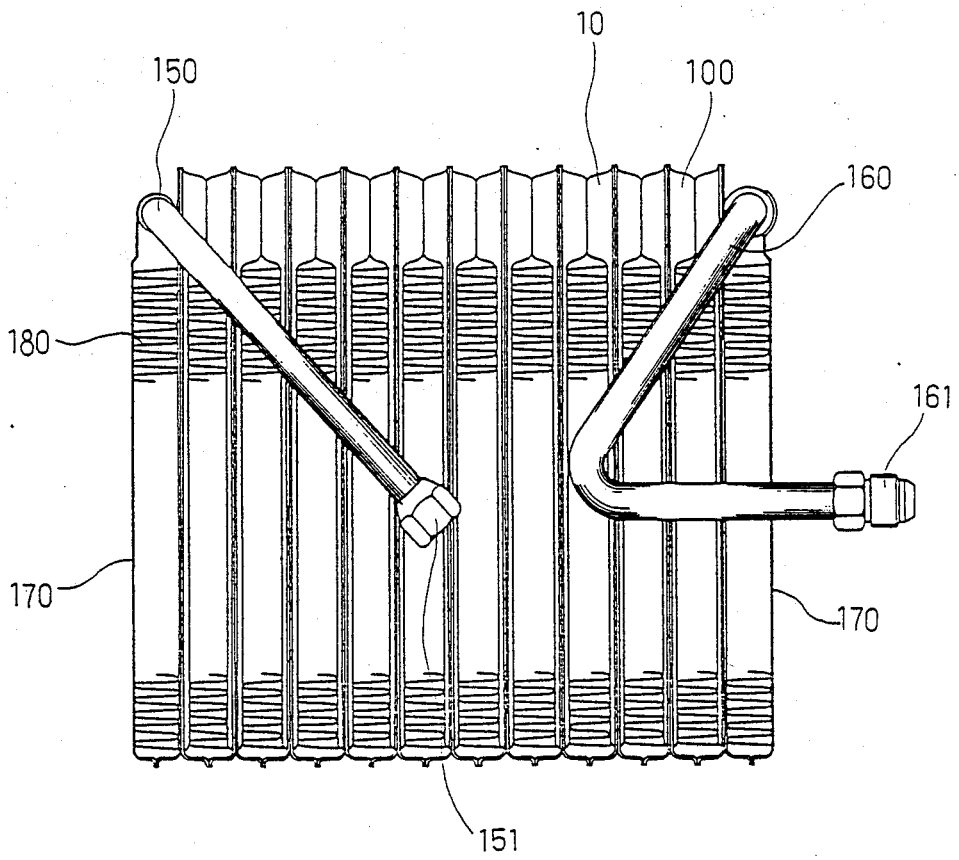
FIG. 4 is a front view of the plate type heat exchanger of the present invention.
Figure 5:
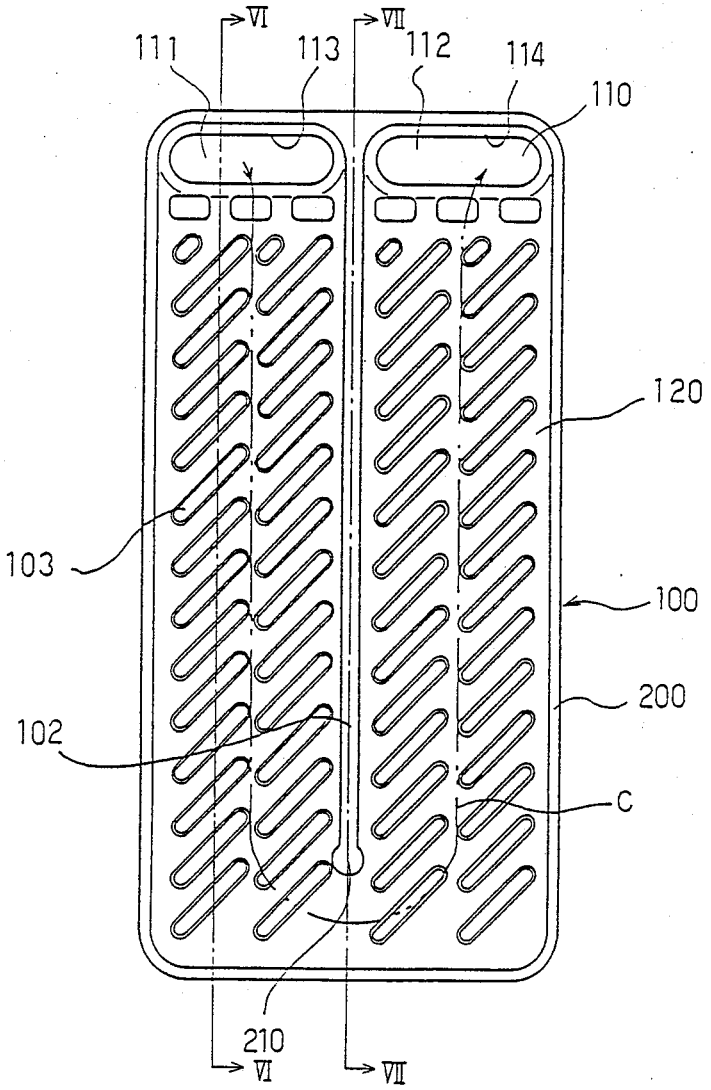
FIG. 5 is a front view of the plate shown in FIG. 4.

The plate type heat exchanger has a plurality of tube units 10, each of which is formed from a couple of plates 100, as shown in FIG. 4. Each plate 100 has a tank portion 110 at an end thereof and a passage portion 120 which connects an inlet tank portion 111 to an outlet tank portion 112 as shown in FIG. 5. Each of the inlet tank portions 111 and the outlet tank portions 112 has through holes 113 and 114 so that each inlet tank portion of each tube unit 100 connects to each other for making an inlet tank unit, and each outlet tank portion of each tube unit is also connected to each other for making an unit of outlet tank. The most rightward inlet tank portion 111 is connected to an inlet tube 150, and the most leftward outlet tank portion 112 is connected to an outlet tube 160. Each of the inlet tube 150 and the outlet tube 160 has a connecting member 151 and 161 at the end portion thereof. Numeral 170 shows a side plate which is provided at the side end portion of the plate type heat exchanger and the side plate protects a corrugated fin 180. The corrugated fin 180 is provided between the side plate 170 and the tube units 10 and between adjacent pairs of the tube units 10 for promoting the heat exchange between the air passing through the plate type heat exchanger and the coolant passing through the passage portion 120 of the tube unit 10.

The heat exchanger of the present embodiment is provided within the air passage in which the air flows toward the passenger compartment so that the air cooled by the plate type heat exchanger is supplied to the passenger's compartment.

As shown in FIG. 5, the plate 100 has a connecting portion 200 at the outer periphery thereof and a center rib 102 which is elongated along with the center axis thereof. Both the connecting portion 200 and the center rib protrude from the remaining portion of the plate 100 so that the plate 100 is formed as a dish shape. The protruding amount of the center .rib 102 is slightly higher than the protruding amount of the connecting portion 200 by about 0.03 mm.

The center rib of the present invention has an enlarged portion 210 at the top end of the center rib 102 so that the width of the enlarged portion 210 is twice that of the center rib 102.

Figures 6, 7:
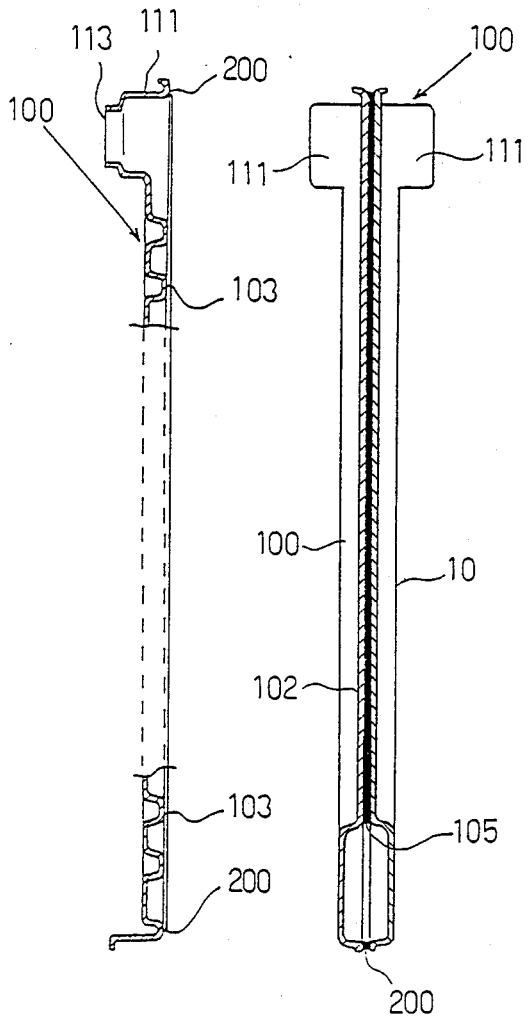
FIG. 6 is a sectional view taken along with VI—VI line in FIG. 5.
FIG. 7 is a sectional view of the tube unit taken along line VII—VII in FIG. 5.

The plate 100 also has a plurality of ribs 103 at the passage portion 120. Each of ribs 103 protrudes from the plate, and the protruding amount of the rib 103 is the same as that of the connecting portion 200 as shown in FIG. 6. The connecting portion 200, the center rib 102 and the ribs 103 are formed by stamping simultaneously.

The core material of the plate 100 is an aluminum alloy (JIS A3003 grade) which has a melting point which is slightly lower than that of the core material and is clad on both surfaces of the core material of the plate 100 as the brazing material.

The assembling and the brazing steps for forming the plate type heat exchanger are explained hereinafter.

At first, a pair of plates 100 abut each other to form the tube unit 10.

Then a plurality of tube units are assembled in such a manner that the corrugated fin 180 is inserted between adjacent pairs of the tube units, and the side plate 170 is also assembled at the side end of the corrugated fin 180. The inlet tube 150 and the outlet tube 160 are also assembled so as to touch the inlet tank portion 111 and the outlet tank portion 112 respectively. The plate type heat exchanger such as shown in FIG. 4 is assembled and the shape thereof is held by a brazing tool (not shown). Then the assembled plate type heat exchanger is conveyed toward a furnace.

The brazing material clad on the outer surface of the plate 100 and the outer surface of the side plate 170 is molten and gathered at the abutting portion between the plate 100 and the corrugated fins 180, between the side plate 170 and the corrugated fin 180, and the connecting portions at the inner side of the plate 100. Since a pair of plates 100 abut each other at the connecting portion 200, the center rib 102 and a part of the ribs 103, the molten brazing material is gathered toward such abutting portions. Since the inclining direction of the ribs 103 of one plate 100 is opposite to the inclining direction of the ribs of another plate, the ribs 103 abut each other at the center portion thereof.

As described before, it had been observed by the present inventors that the molten brazing material has the tendency to gather at the enlarged portion 210. The brazing at the center rib 102 starts from the top end 105 (namely enlarged portion 210), and the molten brazing material flows toward the bottom end 106 of the center rib 102. Therefore, the molten metal should remain at the top end 150 of the center rib 120, shown in FIG. 7. Since the brazing at the top end of the center rib 102 influences the anti-pressure strength of the tube unit 10, as explained above, the tube unit having the enlarged portion 210 at the top end of the center rib 102 has enough anti-pressure strength.

The brazing at the connecting portion 200 is also very important for keeping the effective sealing. Therefore, the brazing at the connection portion 200 is as important as the brazing at the top end 105 of the center rib 102. However since the connecting portion 200 exists at the outer periphery of the plate 100, it is much easier to detect the defects at the connecting portion than to detect the defect at the center rib 102. Namely, the defects caused at the connecting portion 200 can be easily repaired. The defects caused at the center rib 102, on the other hand, are impossible to repair.

The inlet tube 150 is connected to the inlet tank 111 by the brazing material clad on the outer surface of the side plate 170 and also the brazing material clad on the outer surface of the plate 100. The outlet tube 160 is also connected to the outlet tank portion 112 by the brazing material clad on the outer surface of the side plate 170 and clad on the outer surface of the plate 100.

The operation of the plate type heat exchanger of the present invention is explained hereinafter. The coolant is introduced into the inlet tank portion 111 through the inlet tube 150 from an expansion valve of a refrigerating circuit (not shown). The coolant from the inlet tube 150 is introduced to the inlet tank through hole 114. The coolant introduced into the inlet tank then flows through the passage portion 120 along the line C shown in FIG. 5. The flow within the passage portion 120 is disturbed by the ribs 130 which promotes the heat exchange between the coolant and the air outside of the tube unit. The flow of the coolant -U- turns at the enlarged portion 210 of the center rib 102. Since the enlarged portion 210 is circular, the U-turn of the coolant is well guided. The width of the enlarged portion 210 of the present invention is 5.6 mm and the width at the remaining center rib 102 is about 3.6 mm.

According to the present inventors' study, the width of the enlarged portion 210 is better kept less than twice than that at the remaining center rib 102. The enlarged portion 210 chokes the passage area of the passage portion 200 around the enlarged portion 210 if the width of the enlarged portion is too large, namely if the enlarged portion protrudes toward the passage portion 120 too much. It is also observed by the present inventors that the width of the enlarged portion 210 is required to be more than 1.2 times the width at the remaining center rib 102 in order to attain the effective brazing of the present invention.

The coolant passing through passage portion 120 is then introduced into the outlet tank portion 112 and flows toward a compressor of the refrigerant circuit (not shown) through the outlet tube 160.

Figure 8:
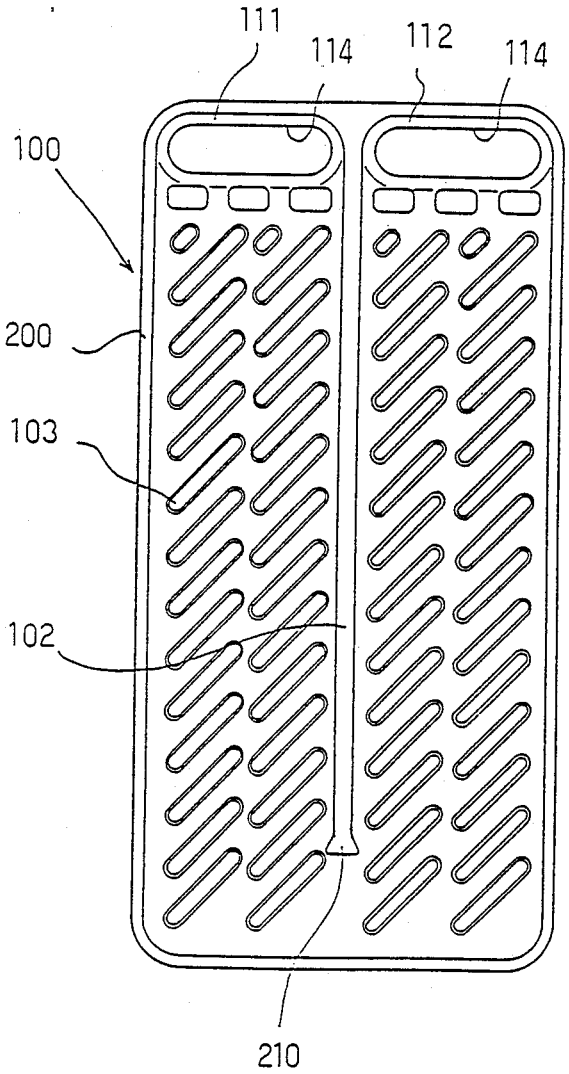
FIG. 8 is a front view of the plate according to another embodiment of the present invention.
Figure 9:
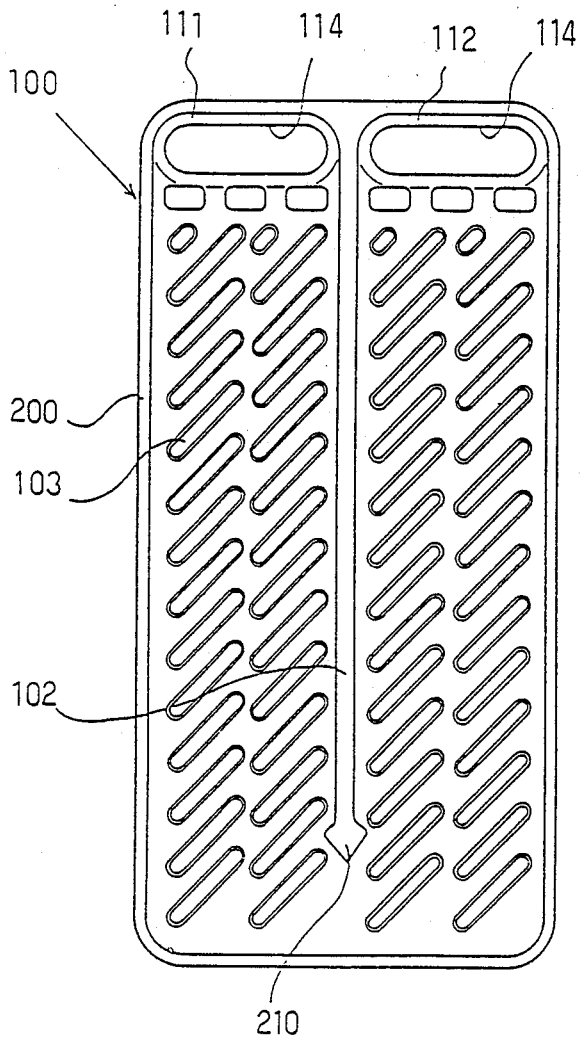
FIG. 9 is a front view of the plate according to further other embodiment of the present invention.

Even though the enlarged portion shown in FIG. 5 is circular, the shape of the enlarged portion of the present invention is not limited to such a shape; a triangular enlarged portion 210 (shown in FIG. 8) and a rectangular enlarged portion 210 (shown in FIG. 9) are also used as the enlarged portion 210.

What is claimed is:

1. A plate type heat exchanger comprising:

a plurality of tube units having an inlet tank portion, a passage portion and an outlet tank portion, with a plurality of corrugated fins provided between adjacent pairs of said tube units, wherein;

each of said tube units is formed by a pair of plates, each of said plates has a connecting portion at a periphery thereof and an elongated center rib disposed along the center axis thereof so that said pair of plates are connected to each other by brazing material at said connecting portion said center rib having a bottom end contiguous with said connecting portion and a top end opposite said bottom end, wherein said center rib, and the width at the top end of said center rib is in the range from 1.2 times to twice the width at the remaining portion of said center rib so as to form an enlarged portion at the top end of said center rib.

2. A plate type heat exchanger according to claim 1, wherein;

said plates further have a plurality of ribs at said passage portion for disturbing the flow passing through said passage portion.

3. A plate type heat exchanger according to claim 2 wherein;

a portion of said rib of one of said pair of plates is connected to a portion of said rib of another one of said pair of plates.

4. A plate type heat exchanger as claimed in claim 1, wherein the width at the top end of said center ribs is in the range from 1.2 times to twice the width at the remaining portion of said center rib.

5. A plate type heat exchanger comprising:

a plurality of tube units having an inlet tank portion, a passage portion and an outlet tank portion, with a plurality of corrugated fins provided between adjacent pairs of said tube units, wherein;

each of said tube units is formed by a pair of plates, each of said plates has a connecting portion at a periphery threof and an elongated center disposed rib along the center axis of said plate so that said pair of plates are connected to each other by brazing material at said connecting portion and said center rib, said center rib having a bottom end contiguous with said connecting portion and a top end opposite said bottom end, wherein a width at the top end of said center rib is 1.2–2 times larger than the width of the remaining portion of said center rib so as to form an elarged portion at the top end of said center rib, and wherein each of said plates is dish-shaped and is formed by said connecting portion and said center rib protruding from a remaining portion of said plate.

6. A plate type heat exchanger claimed in claim 5, wherein;

the protrusion of said center rib is slightly higher than the protrusion of said connecting portion.

7. A plate type heat exchanger according to claim 4, wherein;

the protrusion of said center rib is higher than the protruding amount of said connecting portion by 0.03 mm.

* * * * *